US008544683B2

(12) United States Patent
Springhorn et al.

(10) Patent No.: US 8,544,683 B2
(45) Date of Patent: Oct. 1, 2013

(54) MULTIPLE COMPONENT DISPENSING CARTRIDGE AND METHOD WITH SIDE-BY-SIDE FLUID CHAMBERS

(75) Inventors: Robert W. Springhorn, Cream Ridge, NJ (US); Peter Ngu, Bordentown, NJ (US)

(73) Assignee: Nordson Corporation, Westlake, OH (US)

( * ) Notice: Subject to any disclaimer, the term of this patent is extended or adjusted under 35 U.S.C. 154(b) by 248 days.

(21) Appl. No.: 12/915,833

(22) Filed: Oct. 29, 2010

(65) Prior Publication Data

US 2012/0104030 A1 May 3, 2012

(51) Int. Cl.

| | |
|---|---|
| ***B67D 7/70*** | (2010.01) |
| ***B67D 1/00*** | (2006.01) |
| ***B67D 7/78*** | (2010.01) |
| ***B65D 88/54*** | (2006.01) |
| ***G01F 11/00*** | (2006.01) |
| ***B67B 7/00*** | (2006.01) |

(52) U.S. Cl.
USPC ..... 222/1; 222/137; 222/80; 222/145.5; 222/327

(58) Field of Classification Search
USPC ..... 222/80, 137, 145.5, 326, 327, 136, 222/94, 1
See application file for complete search history.

(56) References Cited

U.S. PATENT DOCUMENTS

| | | | | |
|---|---|---|---|---|
| 2,382,304 | A * | 8/1945 | Foltz et al. | 30/343 |
| 4,493,436 | A | 1/1985 | Brokaw | |
| 4,690,306 | A * | 9/1987 | Staheli | 222/80 |
| 5,449,096 | A | 9/1995 | Sedlmeier | |
| 5,480,067 | A | 1/1996 | Sedlmeier | |

(Continued)

FOREIGN PATENT DOCUMENTS

| | | | |
|---|---|---|---|
| DE | 910054.8 | U1 | 5/1991 |
| DE | 4231420 | A1 | 3/1994 |

(Continued)

OTHER PUBLICATIONS

European Patent Office, European Search Report in EP Application No. 11184183, Feb. 6, 2012.

*Primary Examiner* — Paul R Durand
*Assistant Examiner* — Matthew Lembo
(74) *Attorney, Agent, or Firm* — Wood, Herron & Evans, L.L.P.

(57) ABSTRACT

A fluid cartridge for storing and dispensing first and second fluids includes a first tubular cartridge wall and a second tubular cartridge wall in side-by-side relation. First and second pistons are coupled for movement by a coupling portion and are respectively disposed within the first and second tubular cartridge walls to define first and second side-by-side fluid chambers. A fixed wall is disposed between the first and second fluid chambers. A force is applied to the first piston along the first central longitudinal axis of the first tubular cartridge wall and moves both the first and second pistons along and within the first and second fluid chambers as the coupling portion between the first and second pistons travels within an opening in the fixed wall. The opening may be a preformed slot or may be formed by a cutting element attached with the pistons as the pistons move during the dispensing operation.

26 Claims, 6 Drawing Sheets

(56) References Cited

U.S. PATENT DOCUMENTS

| | | | | |
|---|---|---|---|---|
| 5,535,922 | A * | 7/1996 | Maziarz | 222/137 |
| 5,540,356 | A * | 7/1996 | Camm et al. | 222/80 |
| 5,647,510 | A | 7/1997 | Keller | |
| 6,382,466 | B1 * | 5/2002 | Schneider et al. | 222/137 |
| 6,409,972 | B1 * | 6/2002 | Chan | 422/131 |
| 6,454,129 | B1 | 9/2002 | Green | |
| 6,634,524 | B1 | 10/2003 | Helmenstein | |
| 6,938,797 | B2 | 9/2005 | Brugner et al. | |
| 7,237,693 | B2 | 7/2007 | Brennan et al. | |
| 7,712,635 | B2 * | 5/2010 | Kovac | 222/327 |
| 7,748,567 | B2 | 7/2010 | Horner et al. | |
| 2009/0084815 | A1 | 4/2009 | Paetow et al. | |
| 2009/0277926 | A1 | 11/2009 | Schell | |

FOREIGN PATENT DOCUMENTS

| | | | |
|---|---|---|---|
| DE | 4327755 | A1 | 2/1995 |
| DE | 4335970 | A1 | 4/1995 |
| EP | 0653362 | A1 | 5/1995 |
| EP | 2143662 | A1 | 1/2010 |
| FR | 2702396 | A1 | 9/1994 |
| GB | 1118355 | | 7/1968 |
| GB | 2082686 | A * | 3/1982 |
| GB | 2255596 | A | 11/1992 |
| JP | 2005289470 | A | 10/2005 |
| WO | 93-01993 | A1 | 2/1993 |
| WO | 9509785 | A1 | 4/1995 |

* cited by examiner

MULTIPLE COMPONENT DISPENSING CARTRIDGE AND METHOD WITH SIDE-BY-SIDE FLUID CHAMBERS

TECHNICAL FIELD

The present invention is generally related to multiple component mixing and dispensing cartridges having a side-by-side configuration.

BACKGROUND

Various types of multiple component mixing and dispensing devices exist, including those in which the fluid chambers are in a side-by-side configuration, and those in which the fluid chambers are in a coaxial configuration. Such cartridges often may be placed in a handheld applicator or gun having one or more movable plungers. The plunger(s) move the piston(s) associated with the fluid chambers to dispense and often mix the two component fluids at a distal end of the cartridge.

Previous devices used to mix and dispense two fluids in higher volume ratios have relied on complex internal mechanisms to maintain separation of the two component fluids during storage. Various types of these mechanisms reduce usable volume and create waste product. They also may have various leakage, filling and/or dispensing problems. Oftentimes, these complex mechanisms involve coaxial arrangements of structure allowing a small volume chamber and large volume chamber to reside within the same cylinder. While side-by-side mixer/dispensers are also known, these devices likewise have challenges and complications.

It would be desirable to provide a side-by-side cartridge and a method of dispensing designed to address the various problems and complications involved with current cartridges and methods.

SUMMARY

A first illustrative embodiment of the invention generally provides a fluid cartridge for storing and dispensing at least first and second fluids. The cartridge comprises a first tubular cartridge wall having a first central longitudinal axis and including a first outlet. A second tubular cartridge wall has a second central longitudinal axis and a second outlet. The second tubular cartridge wall is coupled with the first tubular cartridge wall in a side-by-side relation such that the second central longitudinal axis is offset laterally from the first central longitudinal axis. A first piston is disposed within the first tubular cartridge wall. The first tubular cartridge wall and the first piston define a first fluid chamber for the first fluid. A second piston is positioned in side-by-side relation to the first piston and is disposed within the second tubular cartridge wall. The second tubular cartridge wall and the second piston form a second fluid chamber for the second fluid. A force may be applied directly or indirectly to the first piston along the first central longitudinal axis to move both the first and second pistons along the respective first and second central longitudinal axes and within the respective first and second fluid chambers. A coupling portion travels within an opening between the first and second fluid chambers and serves to transfer the force to the second piston, thereby dispensing the first and second fluids from the first and second outlets. The pistons may be separate components of an assembly, for example, or may be integrated or otherwise physically coupled together as an assembly or as a one-piece unit.

In one embodiment, a fixed wall may be disposed between the first fluid chamber and the second fluid chamber. The fixed wall extends parallel to the first and second central longitudinal axes. The coupling portion includes a cutting element extending across the fixed wall. The cutting element is configured to cut a slit in the fixed wall as the first and second pistons are moved along the first and second central longitudinal axes toward the first and second outlets to provide the opening in which the coupling portion travels. The cutting element may further comprise a blade embedded in portions of the first and second pistons and extending across the fixed wall. In another embodiment, a preformed slot is positioned between the first and second fluid chambers and extends along the first and second central longitudinal axes. The slot comprises the opening in which the coupling portion travels as the first and second pistons are moved along the first and second central longitudinal axes toward the first and second outlets. To allow for mixing at the distal end, the first and second outlets may communicate with a common passage. For example, the outlets may couple to a common outlet element which, in turn, leads to a passage in a mixing nozzle. In this embodiment, the distal end of the common outlet element provides for fluid communication between the two outlets so that the fluids can come together just prior to or in the mixing nozzle. The first and second fluid chambers may be sized to have the same volume or may have different volumes. Advantageously, the first fluid chamber may have a larger volume than the second fluid chamber. The volume ratio of the first fluid chamber to the second fluid chamber may be, for example, at least 2:1 and, more preferably, at least 10:1. The fluid chambers and cartridge walls are preferably cylindrical in shape, although other tubular shapes are possible as well.

The invention further provides a method of dispensing two fluids from a fluid cartridge. The method generally includes applying force against a first piston to move the first piston lengthwise within a first fluid chamber having a first central longitudinal axis and a first outlet. A second piston is moved lengthwise within a second fluid chamber having a second central longitudinal axis and a second outlet, with the first and second pistons being directly or indirectly coupled for simultaneous movement by a coupling portion. The first and second fluid chambers are in side-by-side relation such that the second central longitudinal axis is offset laterally from the first longitudinal axis. The method further includes moving the coupling portion along and within an opening disposed between the first fluid chamber and a second fluid chamber and extending parallel to the first and second central longitudinal axes as the first and second pistons move within the first and second fluid chambers. The first and second fluids are then dispensed from the first and second outlets.

The method can further comprise using a cutting element as at least part of the coupling portion and moving this cutting element to cut a slit, which becomes the opening, in a fixed wall by moving the cutting element along with the first and second pistons. Alternatively, the opening may further comprise a preformed slot located between the fluid chambers and the method may further comprise moving the coupling portion along and within the preformed slot. The first and second fluids may be held within first and second collapsible containers in the respective chambers and the method may further comprise collapsing the first and second containers with the first and second pistons while dispensing the first and second fluids from the first and second outlet. The method can further comprise mixing the first and second fluids proximate the first and second outlets. Mixing may take place in any desired volume ratio including, but not limited to, those addressed above.

Various additional features and advantages will become apparent upon review of the following detailed description of the illustrative embodiments taken in conjunction with the accompanying drawings.

DETAILED DESCRIPTION OF THE ILLUSTRATIVE EMBODIMENTS

Figure 1:
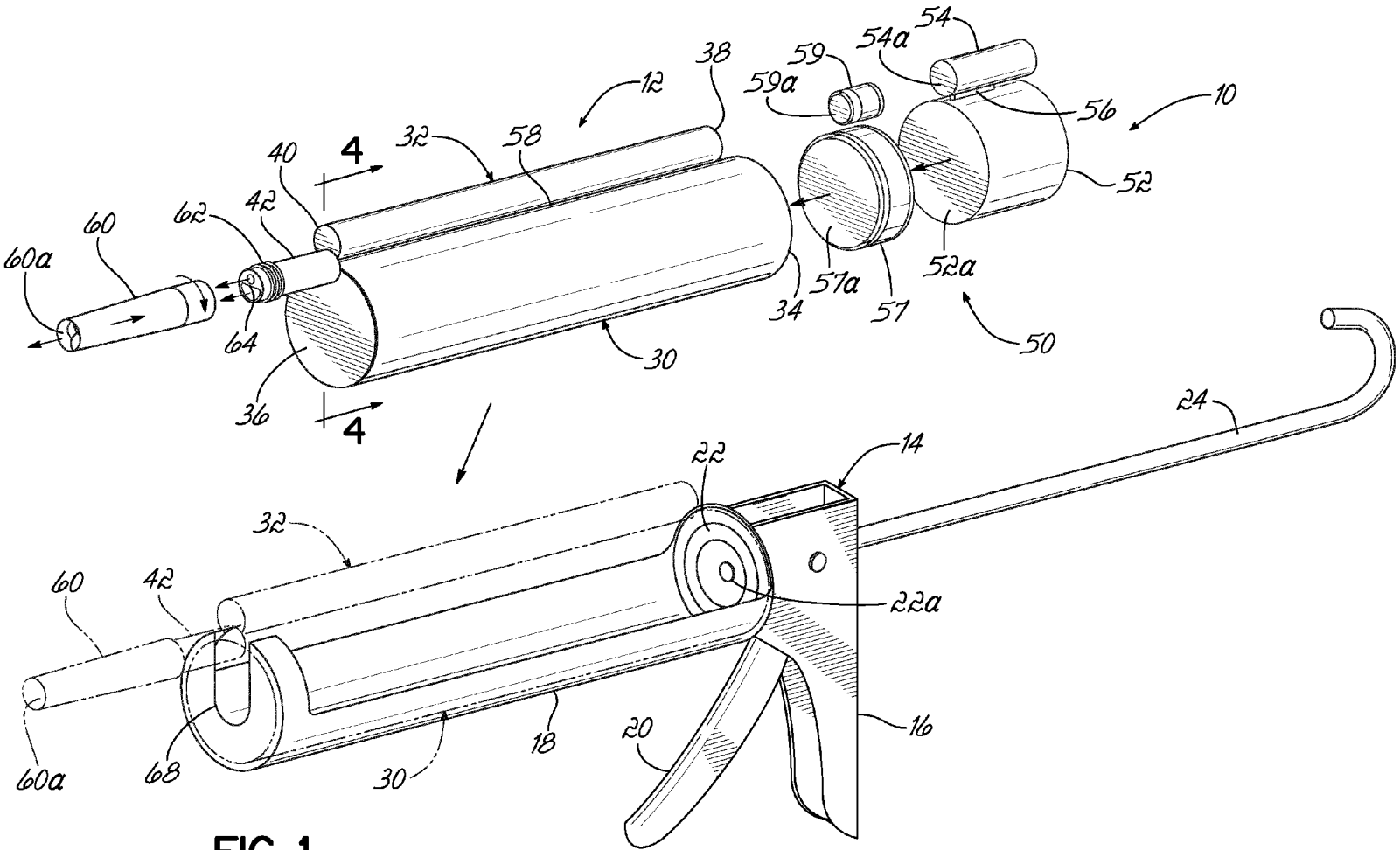
FIG. 1 is a perspective view showing a disassembled view of a cartridge constructed in accordance with a first illustrative embodiment and a standard caulking gun.

FIG. 1 illustrates a first embodiment of the invention in the form of a dispensing unit 10 including a fluid cartridge 12 configured to be used in an actuating unit, such as a standard caulking or dispensing gun 14. The standard caulking gun 14 includes a handle 16 and a cradle 18 for receiving the cartridge 12. A hand-operated squeeze member or trigger 20 is provided for actuating a plunger 22 coupled with a drive rod 24. Actuation of the trigger 20 will move the plunger 22 forward along the cradle 18 by way of a ratcheting mechanism, for example, not shown. The cartridge 12 more specifically comprises a first tubular cartridge wall 30 and a second tubular cartridge wall 32 formed from a suitable plastic, such as polyethylene, or another thin material that may be easily cut for reasons to become apparent. It will be appreciated that further tubular cartridge walls may be provided if it is necessary to dispense three or more fluids. The first tubular cartridge wall 30 includes a proximal end 34 and a distal end 36. The second tubular cartridge wall 32 also includes a proximal end 38 and a distal end 40. An outlet element 42 is rigidly coupled to the respective distal ends 36, 40 for receiving fluid from fluid chambers in each of the tubular cartridge walls 30, 32, as will be described further below. A piston assembly 50, shown disassembled from the cartridges 30, 32 in FIG. 1, includes a piston element 52 and a piston element 54 rigidly connected together by a coupling portion 56. Additional piston elements 57, 59 are also provided. These piston elements 57, 59 are separately inserted into the respective open proximal ends 34, 38 after the cartridges 30, 32 have been filled with respective first and second fluids. The piston elements 52, 54 of the piston assembly 50 are then inserted into the ends 34, 38 behind the piston elements 57, 59 as shown. Forming the pistons from separate piston elements allows the piston elements 57, 59 to be constructed of a different material than the piston elements 52, 54. In this regard, the piston elements 57, 59 may be formed from a softer plastic material that will better seal against the inside of the first and second tubular cartridge walls 30, 32. The piston elements 52, 54 may then be formed from a harder plastic material that is more suitable for transferring pushing forces. It will be appreciated that the separate piston elements 57, 59 may be eliminated and that the piston elements 52, 54 may instead comprise unitary pistons that directly apply force to the fluid. In this alternative, the piston elements 52, 54 may include suitable sealing structure for engaging the inside surfaces of the tubular cartridge walls 30, 32. For example, the piston elements 52, 54 could be molded from two materials, with one being more rigid for structural support and the other being more pliable and on the periphery for providing the sealing structure. One example would be overmolding a thermoplastic elastomer on a rigid Nylon body to form a unitary piston. The coupling portion 56 aligns with a fixed wall 58 which, in this example, comprises a junction between the first tubular cartridge wall 30 and the second tubular cartridge wall 32. A tubular static mixing element 60 is coupled for fluid communication to the distal outlet element 42 by way of threads 62. It will be appreciated that any suitable connection method may be used instead of threads 62. An internal separating element or wall 64 within the outlet element 42 maintains the first and second fluids separate from one another until the fluids enter the static mixing element 60. The mixing element mixes the two fluids and the mixture of the first and second fluids is dispensed from a distal end 60*a* of the mixing element 60. When the cartridge 12 is inserted into the cradle 18, the outlet element 42 will reside in a slot 68.

Figure 3:
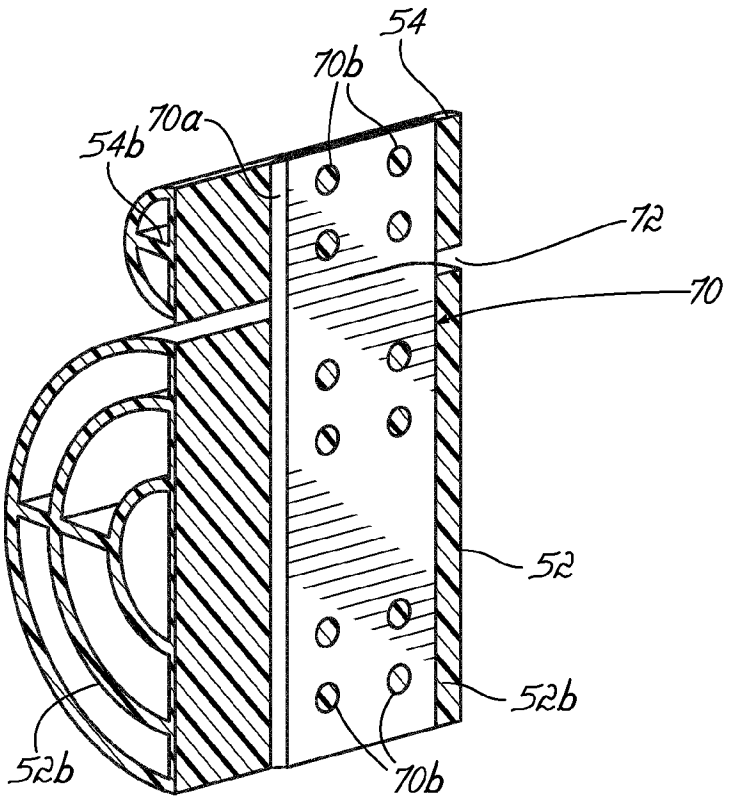
FIG. 3 is a partial cross sectional view taken along line 3-3 of FIG. 2.
Figure 2:
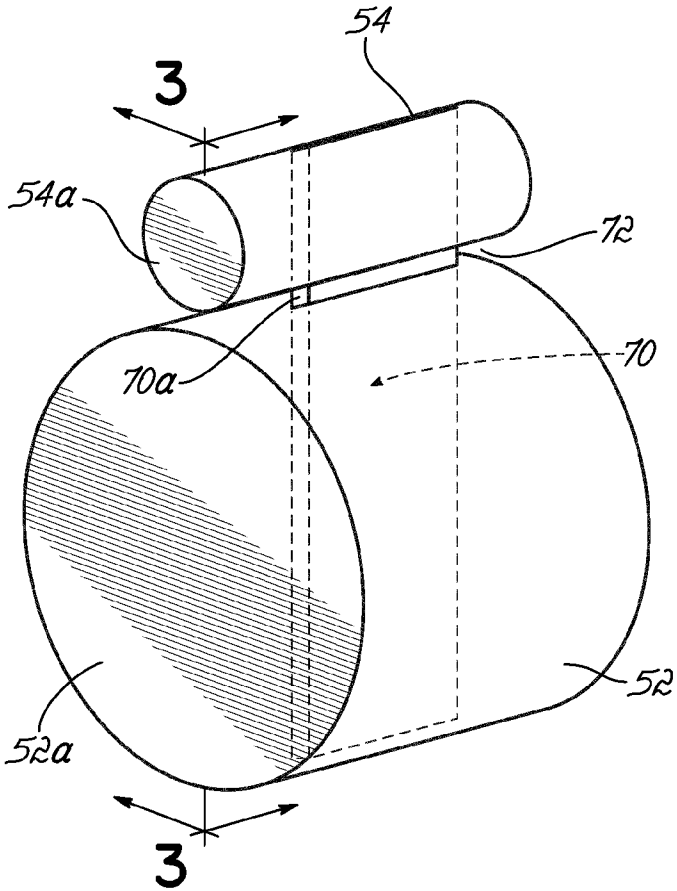
FIG. 2 is a perspective view showing a portion of the piston assembly of the first embodiment.

FIGS. 2 and 3 illustrate the piston elements 52, 54 in greater detail. In this embodiment, the piston elements 52, 54 comprise a plastic molded structure that is generally hollow but may include solid front faces 52*a*, 54*a* for purposes of contacting the piston elements 57, 59 within the first and second tubular cartridge walls 30, 32. It will be appreciated that if the separate piston elements 57, 59 are eliminated, then the front faces 52*a*, 54*a* will instead act directly on the fluids. The front faces have been removed from FIG. 3 to illustrate the internal, hollow structure including the molded structural ribs 52*b*, 54*b* that provide internal support for the piston elements 52, 54. Piston assembly 50 more specifically comprises a cutting element 70 in the form of a blade having a sharpened leading edge 70*a*. The blade 70 is embedded within the piston elements 52, 54, such as during a molding process used to manufacture the piston elements 52, 54, and serves as the coupling portion 56 to couple the two piston elements 52, 54 together. At a gap 72 between the two piston elements 52, 54, the sharpened edge 70*a* is exposed. The blade 70 includes holes 70*b* that receive plastic material during the piston molding process to assist with holding the blade 70 to one or more ribs 52*b*, 54*b* within the piston elements 52, 54.

Figure 4:
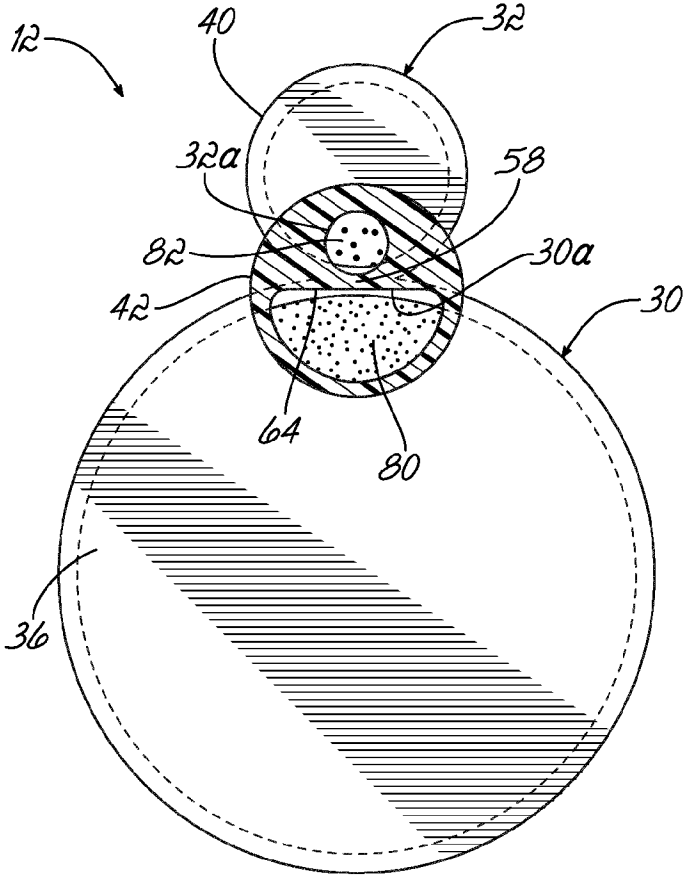
FIG. 4 is a cross sectional view taken along line 4-4 of FIG. 1.
Figure 5:
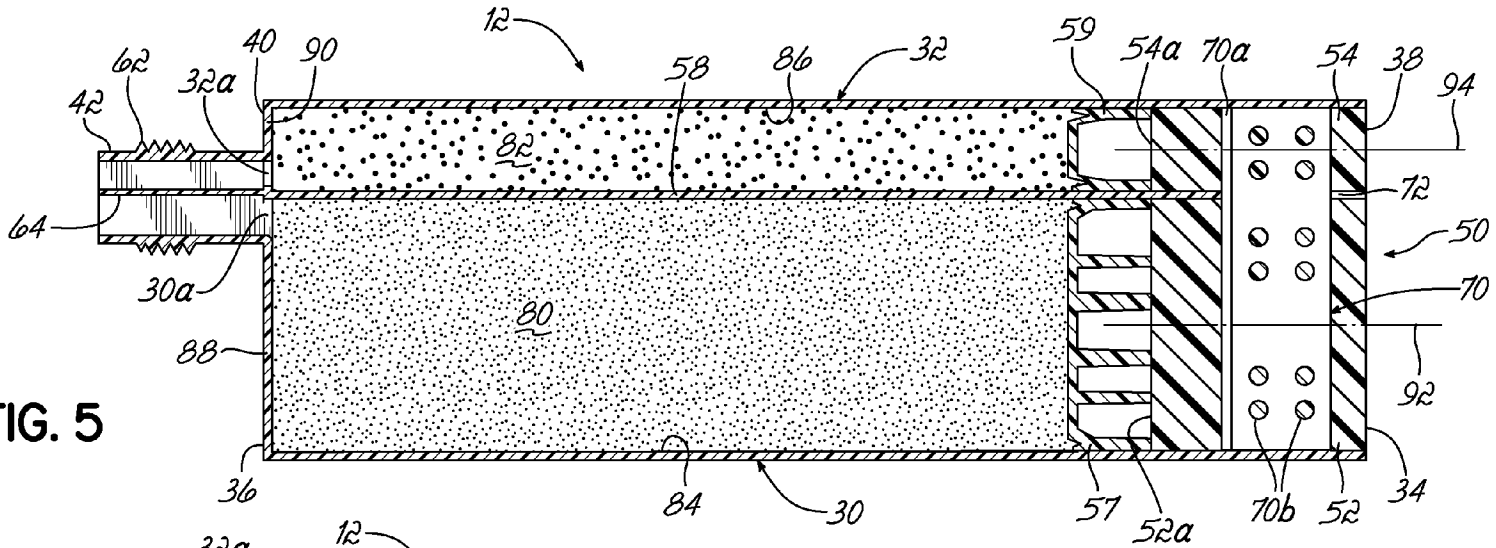
FIG. 5 is a longitudinal cross sectional view generally taken along the lengthwise axis of the cartridge illustrated in FIG. 1, and illustrating initial positions of the piston assembly prior to dispensing.
Figure 6:
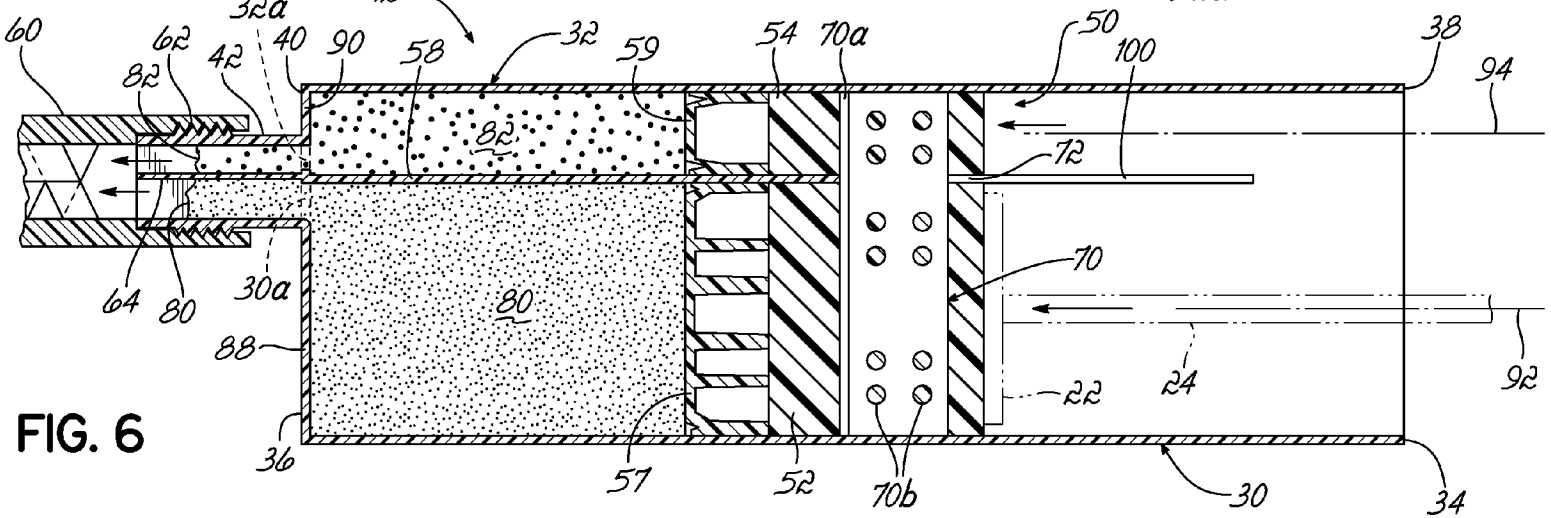
FIG. 6 is a view similar to FIG. 5, but illustrating the piston assembly at a subsequent time during the dispensing process.

FIGS. 4, 5 and 6 illustrate the use of the fluid cartridge 12 to mix and dispense first and second fluids 80, 82, respectively, from the first and second tubular cartridge walls 30, 32 and, more specifically, from first and second fluid chambers 84, 86 defined respectively between front faces 57*a*, 59*a* of the piston elements 57, 59, the first and second tubular cartridge walls 30, 32 and distal walls 88, 90. As shown in FIGS. 5 and 6, the first and second tubular cartridge walls 30, 32 respectively extend along first and second central longitudinal axes 92, 94 in a side-by-side relation such that the second central longitudinal axis 94 is offset laterally from the first central longitudinal axis 92. The first axis 92 is generally located on the center point 22*a* of the plunger 22 while the second axis 94 is located above the cradle 18 (FIG. 1). A fixed wall 58 is disposed between the first fluid chamber 84 and the second fluid chamber 86 and extends generally parallel to the first and second central longitudinal axes 92, 94. In this embodiment, the fixed wall 58 is a common wall between the two fluid chambers 84, 86. This common, fixed wall 58 aligns with the gap 72 between the two piston elements 52, 54 and is aligned for engagement with the portion of the sharpened blade edge 70*a* positioned within this gap 72.

As force is applied to the piston element 52 and the piston element 57 by the plunger 22 (FIG. 6), along the first central longitudinal axis 92, this will move the piston element 52 and the piston element 57 as well as the piston element 54 and the second piston 59. The piston elements 57, 59 will move distally along the respective axes 92, 94 and within the respective fluid chambers 84, 86 pushing the first and second fluids 80, 82 from respective outlets 30*a*, 32*a*. The fluids 80, 82 will move into the distal outlet element 42 and into respective spaces 42*a*, 42*b* (FIG. 4) in the outlet element 42 separated by the wall 64. The fluids 80, 82 will remain separated until they enter the static mixing element 60. In the static mixing element 60, the first and second fluids 80, 82 will be mixed in the ratio provided for by the cartridge 12 and then dispensed as a fluid mixture. This ratio may, for example, be a 1:1 ratio or any other ratio, such as at least 2:1 or, more preferably, at least 10:1. The embodiments of this invention work well with high ratio mixing because the force transmitted directly in line with the larger piston elements 52, 57 will more easily be transferred to the smaller piston elements 54, 59 by the coupling portion 56 (blade 70), i.e., there will be less moment created between the large and small piston elements 52, 57 and 54,59. As one illustrative example, the mixed fluid material may be an epoxy resin adhesive with the first fluid 80 being a resin component and the second fluid 82 being a catalyst in a much smaller amount. As the piston elements 52, 57 and 54, 59 move along and within the fluid chambers 84, 86 as shown in FIG. 6, the sharpened edge 70*a* of the blade 70 will cut an opening 100 in the common wall 58 at a location proximal to the front faces 52*a*, 54*a* of the piston elements 52, 54. This slit or opening 100 allows further travel of the piston assembly 50 during the mixing and dispensing process until substantially all fluid is dispensed.

Figure 7:
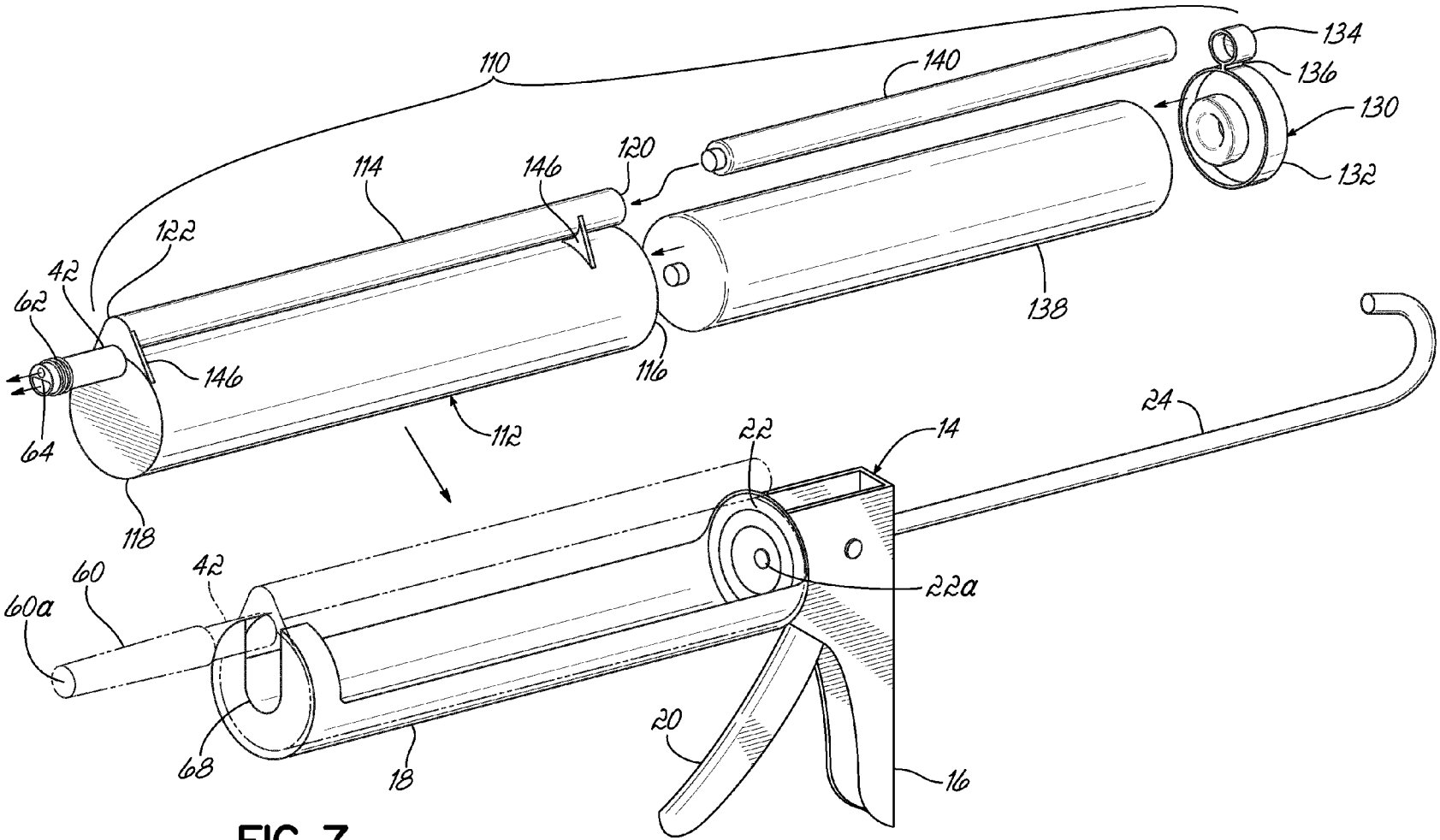
FIG. 7 is a perspective view similar to FIG. 1, but illustrating another illustrative embodiment of the invention.

FIGS. 7-10 illustrate a second embodiment of the invention that eliminates the need for the blade 70 described above. In FIGS. 7-10, like reference numerals refer to like elements of structure in FIGS. 1-6 and, therefore, additional description of such structure is not repeated. As generally shown in FIG. 7, a cartridge 110 is illustrated in a disassembled view and includes a first tubular cartridge wall 112 and a second tubular cartridge wall 114. The first tubular cartridge wall 112 includes a proximal end 116 and a distal end 118. The second tubular cartridge wall 114 also includes a proximal end 120 and a distal end 122. An outlet element 42 is rigidly coupled to the respective distal ends 118, 122 for receiving fluid from fluid chambers 124, 126 in each of the tubular cartridge walls 112, 114, in a manner to be described further below. A piston unit 130 includes a first piston 132 and a second piston 134 rigidly connected together by a coupling portion 136. First and second collapsible containers 138, 140 of fluid 142, 144 are received in the open proximal ends 116, 120 of the tubular cartridge walls 112, 114. For example, these collapsible containers 138, 140 may be comprised of flexible bags holding the desired fluids to be mixed and dispensed. After the collapsible bags 138, 140 of fluid 142, 144 are received within the fluid chambers 124, 126 of the cartridge walls 112, 114, the proximal, open ends 116, 120 of the cartridge walls 112, 114 receive the respective first and second pistons 132, 134. The first cartridge wall 112 is rigidly affixed to the second cartridge wall 114 by flanges or connecting members 146 (FIG. 7).

Figure 8:
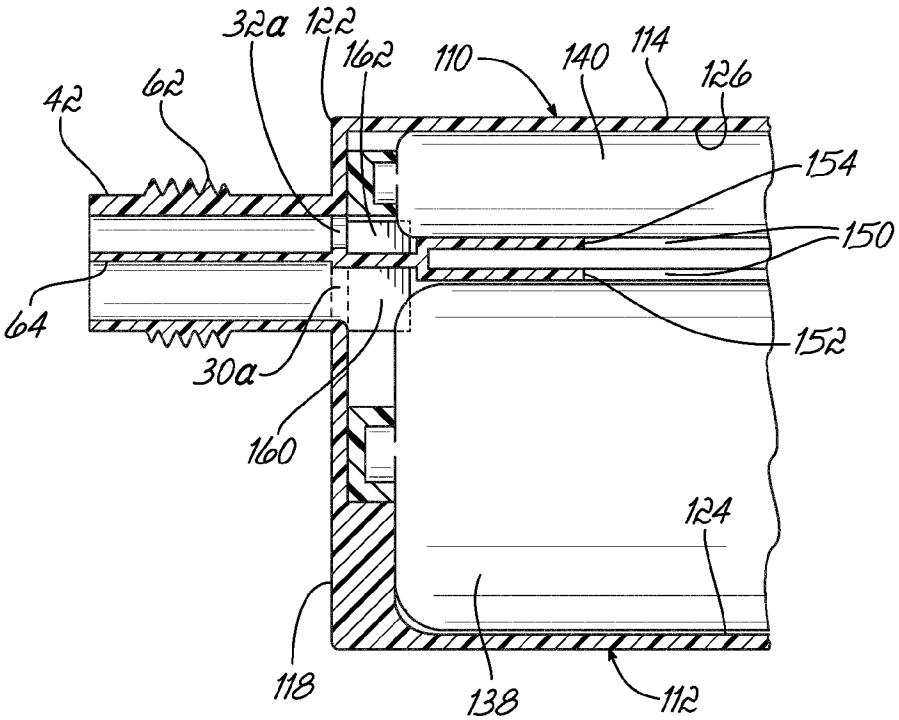
FIG. 8 is a cross sectional view taken generally along the longitudinal axis of the cartridge at the distal end.
Figure 9:
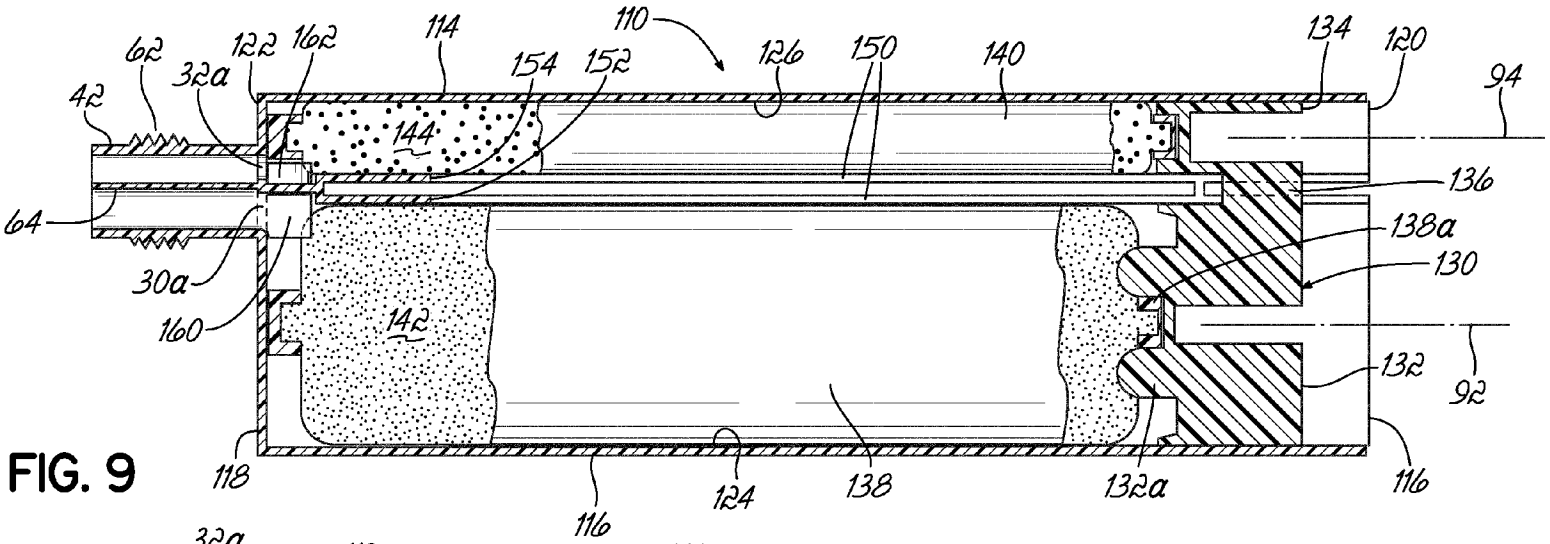
FIG. 9 is a cross sectional view taken along the longitudinal axis of the cartridge shown in FIG. 7, and showing initial positions of the pistons prior to dispensing.
Figure 10:
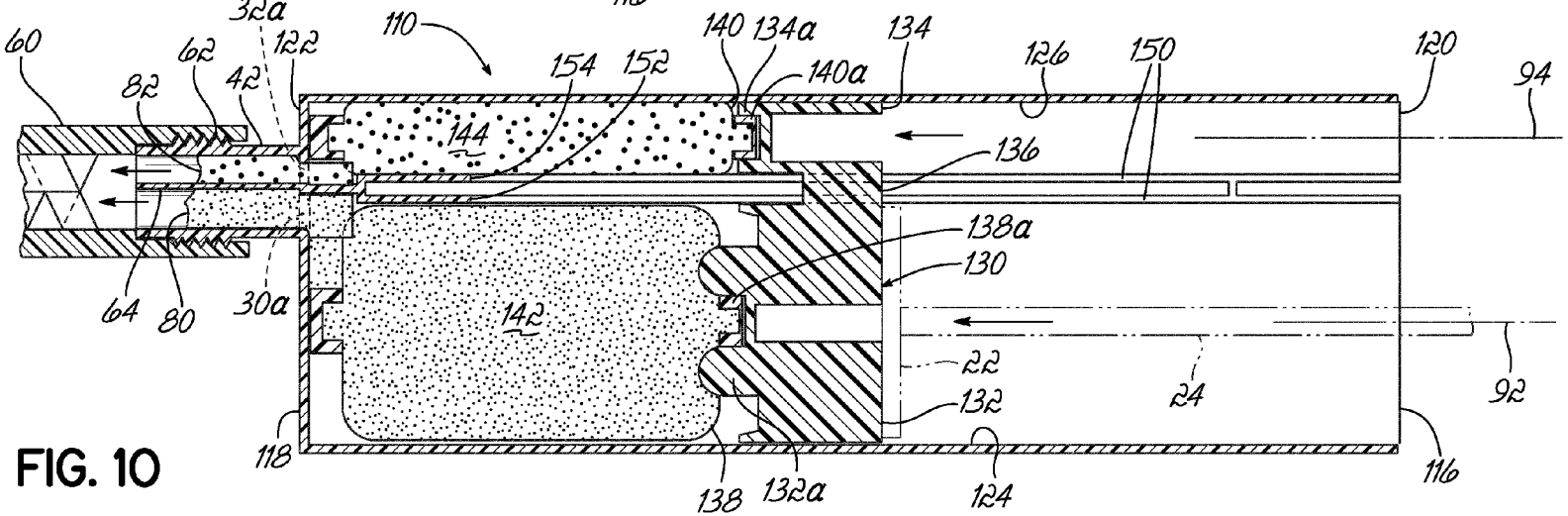
FIG. 10 is a cross sectional view similar to FIG. 9, but illustrating the pistons at a subsequent time during the dispensing process.

As best illustrated in FIGS. 8-10, a preformed slot 150 extends lengthwise through the cartridge walls 112, 114 from the proximal ends 116, 120 of each wall 112, 114 to a more distal portion 152, 154 of each wall 112, 114. This slot 150 receives the coupling portion 136 of the piston unit 130 for lengthwise movement as shown in FIGS. 9 and 10. The slot 150, in this embodiment, is open at the proximal ends 116, 120 and closed at the distal portions 152, 154. Also as best shown in FIGS. 8 and 9, the distal portion of each fluid chamber 124, 126 includes a blade element 160, 162 mounted therein and engageable with the respective collapsible bag or container 138, 140. Each blade element 160, 162 (which may be formed separately or as an integral piece) is configured to cut a respective bag 138, 140 as pressure is applied by the piston unit 130 and allow the first and second fluids 142, 144 to escape from the bags 138, 140 and enter the distal outlet element 42 through respective outlets associated with the first and second tubular cartridge walls 112, 114 as disclosed in the first embodiment (see outlets 30*a*, 32*a* in FIG. 4). Distal portions 132*a*, 134*a* of each piston 132, 134 receive and, preferably, couple with proximal portions 138*a*, 140*a* of the respective collapsible bags 138, 140 of fluid 142, 144. As force is applied to the first piston 132 by the plunger 22 (FIG. 6), along the first central longitudinal axis 92, this will move the first piston 132 as well as the second piston 134, which is coupled to the first piston 132 by the coupling portion 136, distally along the first and second axes 92, 94. The pistons 132, 134 will move along and within the respective fluid chambers 124, 126 pushing the first and second fluids 142, 144 out of the ruptured distal ends of each bag 138, 140 and into the distal outlet element 42. It will be appreciated that the pistons 132, 134 do not need to seal against the internal surfaces of the cartridge walls 112, 114 in order to function properly in this embodiment. The remainder of the mixing and dispensing process is as described with regard to the first embodiment. At the end of the mixing and dispensing process, each collapsible bag 138, 140 will be fully collapsed within the respective fluid chamber 124, 126 with nearly all fluid being mixed and dispensed at that time.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A fluid cartridge for storing and dispensing first and second fluids using a dispensing gun having a single cradle configured to receive a single cylindrical cartridge and a single plunger coupled with a drive rod moveable along a drive rod axis, the fluid cartridge comprising:

a first tubular cartridge wall having a first central longitudinal axis and including a first outlet, the first tubular cartridge wall being configured to be received in the cradle of the dispensing gun so the first central longitudinal axis is aligned with the drive rod axis;

a second tubular cartridge wall having a second central longitudinal axis and a second outlet, the second tubular cartridge wall coupled with the first tubular cartridge wall in a side-by-side relation such that the second central longitudinal axis is offset laterally from the first central longitudinal axis, and such that the second central longitudinal axis is offset laterally from the drive rod axis when the first tubular cartridge wall is received in the cradle of the dispensing gun;

a first piston element disposed within the first tubular cartridge wall, wherein the first tubular cartridge wall and the first piston element define a first fluid chamber for the first fluid;

a second piston element positioned in the second tubular cartridge wall, wherein the second tubular cartridge wall and the second piston element form a second fluid chamber for the second fluid;

wherein a coupling portion extends generally between the first and second piston elements, and wherein a force may be applied by the plunger to the first piston element along the first central longitudinal axis to move both the first and second piston elements along the respective first and second central longitudinal axes and within the respective first and second fluid chambers as the coupling portion travels within an opening between the first and second fluid chambers, thereby dispensing the first and second fluids from the first and second outlets.

2. The fluid cartridge of claim 1, further comprising:

a fixed wall disposed between the first fluid chamber and the second fluid chamber and extending parallel to the first and second central longitudinal axes; and wherein the coupling portion further comprises a cutting element coupled directly or indirectly with the first and second piston elements and extending across the fixed wall, the cutting element configured to cut a slit in the fixed wall as the first and second piston elements are moved along the first and second central longitudinal axes toward the first and second outlets.

3. The fluid cartridge of claim 2, wherein the cutting element further comprises a blade embedded within the first and second piston elements and extending across the fixed wall.

4. The fluid cartridge of claim 2, wherein the first and second piston elements each comprise a multi-piece assembly.

5. The fluid cartridge of claim 1, wherein the first and second outlets communicate with a common passage to allow mixing of the first and second fluids.

6. The fluid cartridge of claim 1, wherein the volume ratio of the first fluid chamber to the second fluid chamber is at least 2:1.

7. The fluid cartridge of claim 1, wherein the volume ratio of the first fluid chamber to the second fluid chamber is at least 10:1.

8. The fluid cartridge of claim 1, further comprising:

a slot positioned between the first and second fluid chambers, and extending along the first and second central longitudinal axes, the coupling portion riding in the slot as the first and second pistons are moved along the first and second central longitudinal axes toward the first and second outlets; and first and second collapsible containers respectively holding the first and second fluids and positioned in the first and second fluid chambers.

9. The fluid cartridge of claim 1, wherein the first piston element includes a first component and a second component, the first component being of a softer material than the second component, and wherein the second piston element includes a third component and a fourth component, the third component being of a softer material than the fourth component.

10. The fluid cartridge of claim 9, wherein the first and second components of the first piston element are separate components, and wherein the third and fourth components of the second piston element are separate components.

11. The fluid cartridge of claim 9, wherein the first and second components form a unitary first piston element, and wherein the third and fourth components form a unitary second piston element.

12. In combination, a dispensing gun and the fluid cartridge set forth in claim 1, the dispensing gun including a plunger coupled with a drive rod, wherein the force applying structure is engaged by the plunger of the dispensing gun.

13. A fluid cartridge for storing and dispensing first and second fluids using a dispensing gun having a single cradle configured to receive a single cylindrical cartridge and a single plunger coupled with a drive rod moveable along a drive rod axis, the fluid cartridge comprising:

a first cylindrical cartridge wall having a first central longitudinal axis and including a first outlet, the first cylindrical cartridge wall being configured to be received in the cradle of the dispensing gun so the first central longitudinal axis is aligned with the drive rod axis;

a second cylindrical cartridge wall having a second central longitudinal axis and a second outlet, the second cylindrical cartridge wall coupled with the first cylindrical cartridge wall in a side-by-side relation such that the second central longitudinal axis is offset laterally from the first central longitudinal axis, and such that the second central longitudinal axis is offset laterally from the drive rod axis when the first cylindrical cartridge wall is received in the cradle of the dispensing gun;

a first piston element disposed within the first cylindrical cartridge wall, wherein the first cylindrical cartridge wall and the first piston element define a first fluid chamber for the first fluid;

a second piston element positioned in the second cylindrical cartridge wall, wherein the second cylindrical cartridge wall and the second piston element form a second fluid chamber for the second fluid, the second fluid chamber being smaller in volume than the first fluid chamber by a ratio of at least 2:1;

wherein a coupling portion extends generally between the first and second piston elements, and wherein a force may be applied by the plunger to the first piston element along the first central longitudinal axis to move the first and second piston elements along the respective first and second central longitudinal axes and within the respective first and second fluid chambers as the coupling portion travels within an opening between the first and second fluid chambers, thereby dispensing the first and second fluids from the first and second outlets.

14. The fluid cartridge of claim 13, further comprising:

a fixed wall disposed between the first piston element and the second piston element and extending parallel to the first and second central longitudinal axes; and wherein the coupling portion further comprises a cutting element coupled directly or indirectly with the first and second piston elements and extending across the fixed wall, the cutting element configured to cut a slit in the fixed wall as the first and second piston elements are moved along the first and second central longitudinal axes toward the first and second outlets.

15. The fluid cartridge of claim 14, wherein the cutting element further comprises a blade embedded within the first and second piston elements and extending across the fixed wall.

16. The fluid cartridge of claim 15, wherein the first and second piston elements each comprise a multi-piece assembly.

17. The fluid cartridge of claim 13, wherein the first and second outlets communicate with a common passage to allow mixing of the first and second fluids.

18. The fluid cartridge of claim 13, wherein the volume ratio of the first fluid chamber to the second fluid chamber is at least 10:1.

19. The fluid cartridge of claim 13, further comprising:

a slot positioned between the first and second fluid chambers, and extending along the first and second central longitudinal axes; and first and second collapsible containers respectively holding the first and second fluids and positioned in the first and second fluid chambers;

wherein the coupling portion rides in the slot as the first and second pistons are moved along the first and second central longitudinal axes toward the first and second outlets.

20. A method of using a dispensing gun having a plunger coupled with a drive rod moveable along a drive rod axis to dispense two fluids from a fluid cartridge including a first fluid chamber having a first central longitudinal axis and a first outlet, and a second fluid chamber having a second central longitudinal axis and a second outlet, the first and second fluid chambers being in side-by-side relation such that the second central longitudinal axis is offset laterally from the first central longitudinal axis, the dispensing gun further having a single cradle configured to receive a single cylindrical cartridge such that the first central longitudinal axis is aligned with the drive rod axis and the second central longitudinal axis is laterally offset from the drive rod axis, the method comprising:

moving the plunger into force-applying engagement with a first piston element;

moving the first piston element lengthwise within the first fluid chamber;

moving a second piston element lengthwise within the second fluid chamber;

moving a coupling portion along and within an opening extending lengthwise between the first fluid chamber and the second fluid chamber and in a direction extending parallel to the first and second central longitudinal axes to transfer force generally between the first and second piston elements as the first and second piston elements move within the first and second fluid chambers; and dispensing the first and second fluids from the first and second outlets.

21. The method of claim 20, wherein the coupling portion further comprises a cutting element, and moving the coupling portion further comprises cutting a slit in a fixed wall between the first and second fluid chambers by moving the cutting element.

22. The method of claim 20, wherein the opening further comprises a preformed slot, and the method further comprises:

moving the coupling portion along and within the preformed slot.

23. The method of claim 22, wherein the first and second fluids are respectively held within first and second collapsible containers, and the method further comprises:

collapsing the first and second containers with the first and second pistons while dispensing the first and second fluids from the first and second outlets.

24. The method of claim 20, further comprising:

mixing the first and second fluids proximate the first and second outlets.

25. The method of claim 24, wherein mixing the first and second fluids further comprises:

mixing the first and second fluids in a volume ratio of at least 2:1.

26. The method of claim 24, wherein mixing the first and second fluids further comprises:

mixing the first and second fluids in a volume ratio of at least 10:1.

* * * * *